United States Patent [19]

Walker

[11] 3,971,582

[45] July 27, 1976

[54] DOOR LATCH

[76] Inventor: Brooks Walker, 807 Francisco St., San Francisco, Calif. 94109

[22] Filed: Nov. 13, 1974

[21] Appl. No.: 523,199

[52] U.S. Cl. ..... 292/268; 292/259 R

[51] Int. Cl.[2] ..... E05C 17/06

[58] Field of Search ..... 292/259, 268, 262, 263; 70/93

[56] References Cited

UNITED STATES PATENTS

| | | | |
|---|---|---|---|
| 671,063 | 4/1901 | Butler | 292/259 X |
| 924,277 | 6/1909 | Saphier | 292/259 |
| 1,785,772 | 12/1930 | Hallam et al. | 292/268 |
| 2,038,462 | 4/1936 | Wellman | 292/238 X |
| 2,683,049 | 7/1954 | Van Der Spek | 292/238 X |
| 3,690,709 | 9/1972 | Bogusz | 292/259 |

*Primary Examiner*—Richard E. Moore
*Attorney, Agent, or Firm*—Gordon Wood

[57] ABSTRACT

A safety latch for holding a door in its locked position or in a partially open position to enhance security. A bar for holding the door in either position is provided together with keepers cooperating with the bar to perform the holding functions. The said bar may be mounted to take the place of one hinge pin.

4 Claims, 7 Drawing Figures

Fig. 1
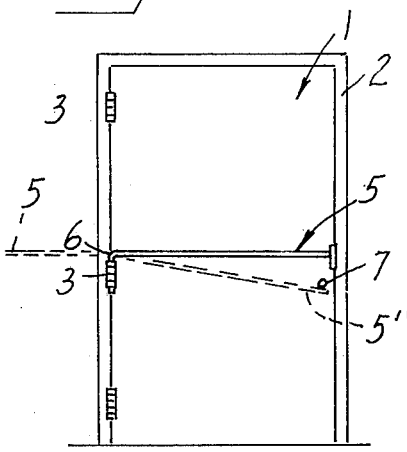
Fig. 2
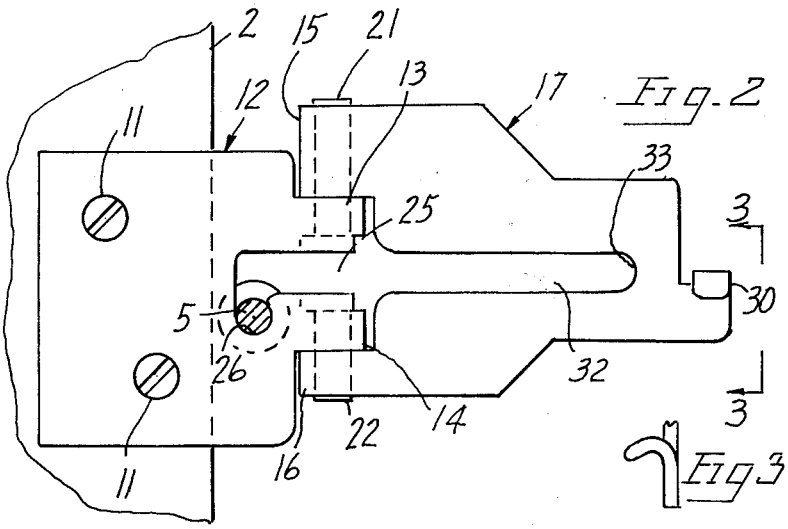
Fig 3
Fig. 4
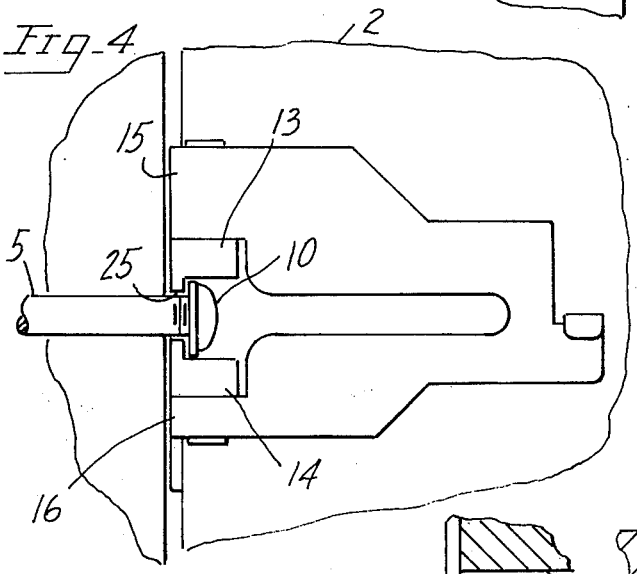
Fig. 5
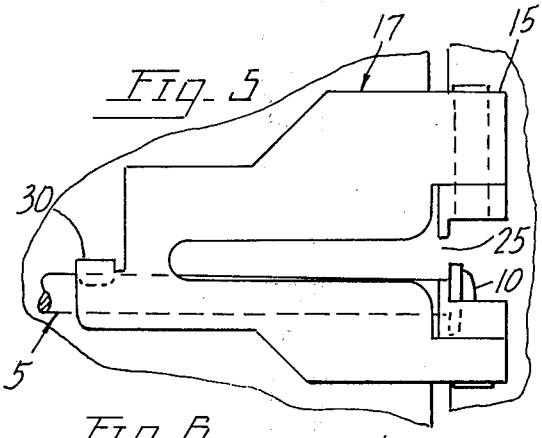
Fig. 6
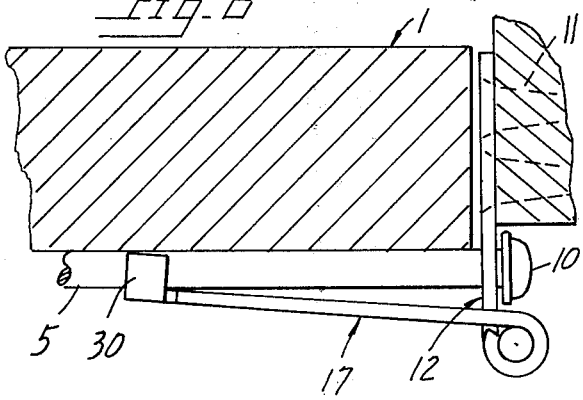
Fig. 7
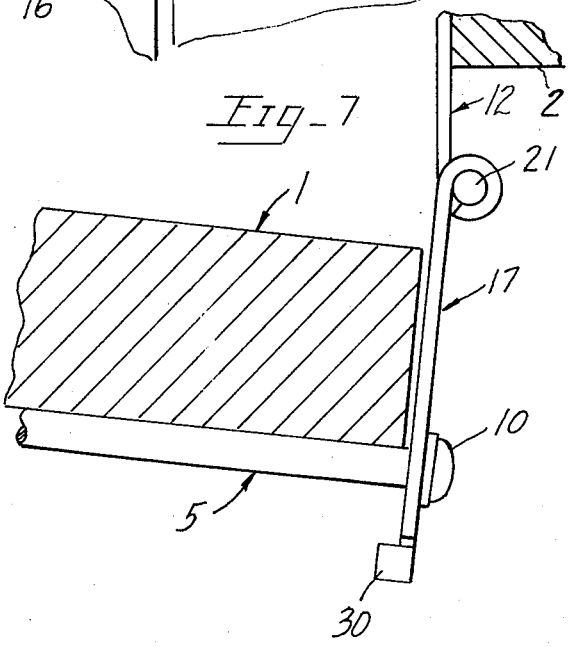

DOOR LATCH

This invention relates to a safety latch for holding a door in either a closed locked position, or a partially open position. When holding the door in closed position, the bar provides additional security over that derived from the use of conventional door locks, latches, chains and the like. When holding the door in a partially open position, it again provides security for the user and permits him to speak through the opening between the door and the frame without permitting the door to be swung past the partially open position.

The main object of the present invention is to provide a bar of the above described nature which is easily installed and which at the same time provides optimum security for the occupant of the house or apartment using the same.

Another object of the invention is the provision of a safety latch incorporating a holding bar which may be moved from a position holding the door closed to a position holding the door partially open and at the same time permit the door to be held against opening when the latch is between the closed and partially open positions without being unlocked between the two positions.

Heretofore, it has been customary to provide a secondary door holding means in addition to the customary door lock or latch. such prior art holding means has generally comprised a chain which is secured at one end to the door frame and adapted to be secured at its other end to a slotted member on the door to permit the door to be held in a partially opened position against further opening by a person outside the door. Such chain devices are characteristically weak in construction and the screws holding the chain attaching elements are usually placed in a manner so as not to provide a great amount of resistance against the door being pushed or kicked further open from the outside.

Another object of the invention is the provision of a door holding means which constitutes an improvement over the prior art in that the same is stronger than analogous devices heretofore available.

Other objects and advantages will be apparent from the following specification and from the drawings.

FIG. 1 is a side elevation of the interior side of a door structure showing the door and frame and the holding bar cooperating therewith.

FIG. 2 is a side elevation of the door frame at the latch edge of the door showing the keepers mounted thereon in coplanar relationship.

FIG. 3 is a fragmentary end elevation of the swingable keeper.

FIG. 4 is a fragmentary elevation of the door and frame showing the swingable keeper in its inoperative position and with the holding bar received within the fixed keeper.

FIG. 5 is a view similar to FIG. 4 but with the swingable keeper swung to its bar holding position.

FIG. 6 is a horizontal sectional view of the structure of FIG. 5.

FIG. 7 is a horizontal sectional view similar to FIG. 6 but showing the latch holding the door in partially opened position.

Referring to FIG. 1, the invention is adapted to be used with a door generally designated 1 swingably mounted in a frame 2 by means of hinges 3. Extending horizontally across the door 1 is a holding bar generally designated 5 which may be formed at one end with a laterally offset portion 6. For the purpose of swingably mounting the bar 5, the hinge pin of the central hinge 3 may be removed so that said offset portion 6 can be received through the hinge knuckles. At this point it will be noted that if it is desired not to use the bar 5, the same may be swung away from a door to the dot-dash position indicated in FIG. 1 or to a lowered position 5' against a stop 7. The invention also contemplates mounting the left hand end of the bar on the door.

The end of the bar 5 opposite the hinge 3 is provided with a head 10 which may take the form of a flat nut threadedly secured to the end of bar 5 (FIG. 4).

Secured to the frame 2 at the latch edge of the door by means of screws 11 is a fixed keeper plate generally designated 12 which is formed at its outer end with hinge knuckles 13, 14. Swingably secured on said hinge knuckles 13, 14 are similar hinge knuckles 15, 16 of a second keeper generally designated 17. Hinge pins 21, 22 are fixedly secured within hinge knuckles 13, 14 so that the second keeper 17 is swingably supported on fixed keeper 12. Swingable keeper 17 may be swung to an inactive position against the frame 2 as shown in FIG. 4. In such a case the free end of bar 5 may be moved along a slot 25 formed in keeper 12 between the knuckles 13, 14. The slot 25 terminates in a laterally offset portion 26 (FIG. 2) into which the end of bar 5 is adapted to be received as seen in FIG. 2. In this position it will be noted that the door 1 is held against inward movement by the keeper 12. In order to insure that the bar 5 cannot be lifted upwardly from the position of FIG. 2 by means of a thin element passed between the door and the frame, the outer end of the swingable keeper 17 is provided with a lug 30 which, when the keeper 17 is swung toward the door to the position of FIG. 5, said lug 30 may engage the top of bar 5 to hold the latter against upward movement out of the offset portion 26 of slot 25.

As best seen in FIG. 2 the swingable keeper 17 is provided with an elongated slot 32 which, when the two keepers 12, 17 are in substantially coplanar relationship, permits the outer end of the bar 5 to be moved along slot 32 and into engagement with the inner end 33 thereof. This permits the door 1 to be swung to the partially open position of FIG. 7 wherein the door 1 is held against any further opening movement so that the party inside the door may talk to one outside, or receive a letter or other small item through the opening.

It will be noted that one of the features of the above described structure is that the rod 5 may be moved from the fully locked position of FIGS. 2, 5 and 6 to the partially opened position of FIG. 7 without disconnecting the bar 5 from keeper plates 12 and 17. By this structure an intruder is prevented from pushing or kicking the door open while the resident is moving the latch from the fully locked position to the partially open position.

I claim:

1. In a door structure that includes a frame, and a door having a hinge edge and an opposite latch edge, a safety latch for holding said door against opening, comprising:

a bar swingably supported at one of its ends on said door structure, a keeper mounted on said frame adjacent said latch edge of the door, said keeper being formed with a horizontally outwardly opening slot for receiving the opposite end of said bar therealong, said slot having a vertically offset portion for receiving said opposite end therein to prevent opening of the door, a second keeper swingably connected to said first mentioned keeper, said second keeper being formed with an elongated slot having an open end adjacent said first mentioned keeper and in alignment with the slot in said first mentioned keeper when said keepers are in substantially coplanar relation, whereby said opposite end of said bar may be moved along said elongated slot to the inner end thereof to permit said door to be partially opened to a position against said bar.

2. A latch according to claim 1 wherein said second keeper is provided with a stop adapted to engage said bar for holding the latter in said offset position when said door is closed.

3. A latch according to claim 1 wherein said second keeper is adapted to be swung to a position against said frame to permit removal of bar from said first mentioned slot.

4. A latch according to claim 1 wherein said rod is provided with an enlargement at said opposite end, said first and second keepers providing an opening when the second keeper is folded back toward said frame and approximately at right angle to said first keeper to allow the head end of said bar to pass into the slot in said first keeper, said head on said rod being substantially larger than the slot in said first and second keepers to keep said second keeper from being forced away from the end of said rod to disengage said rod from said second keeper when said door is in the secured partially open position.

* * * * *